US006311598B1

(12) United States Patent
Osborne

(10) Patent No.: US 6,311,598 B1
(45) Date of Patent: Nov. 6, 2001

(54) GUIDE FOR CONCRETE CUTTING CHAIN SAW

(75) Inventor: Ian S. Osborne, Hillsboro, OR (US)

(73) Assignee: Blount, Inc., Portland, OR (US)

( * ) Notice: Subject to any disclaimer, the term of this patent is extended or adjusted under 35 U.S.C. 154(b) by 0 days.

(21) Appl. No.: 09/506,841

(22) Filed: Feb. 18, 2000

(51) Int. Cl.[7] ..... B27B 17/02; B26D 5/00; B28D 1/08

(52) U.S. Cl. ..... 83/745; 125/21; 30/372; 30/383; 83/699.51

(58) Field of Search ..... 83/745, 788, 821, 83/823, 829, 698.11, 699.51; 125/25, 21; 30/372, 381, 374, 375, 376, 382–387

(56) References Cited

U.S. PATENT DOCUMENTS

| | | | | |
|---|---|---|---|---|
| 3,545,422 | * | 12/1970 | McNulty | 125/22 |
| 3,722,497 | * | 3/1973 | Hiestand et al. | 125/14 |
| 3,789,279 | | 1/1974 | Dempsey . | |
| 4,031,437 | | 6/1977 | Dempsey . | |
| 4,054,179 | | 10/1977 | Destree . | |
| 4,181,115 | * | 1/1980 | Weisner | 125/21 |
| 4,310,198 | | 1/1982 | Destree . | |
| 4,357,120 | | 11/1982 | MacDonald . | |
| 4,557,245 | | 12/1985 | Bieri . | |
| 4,748,966 | | 6/1988 | Kennedy . | |
| 4,755,003 | | 7/1988 | Pinkerton . | |
| 4,767,162 | | 8/1988 | Reed . | |
| 4,778,304 | | 10/1988 | Baldi . | |
| 4,836,494 | * | 6/1989 | Johnsen | 248/669 |
| 4,848,845 | | 7/1989 | Kennedy . | |
| 4,870,946 | | 10/1989 | Long . | |
| 4,920,947 | * | 5/1990 | Scott et al. | 125/21 |
| 4,981,129 | * | 1/1991 | Osterman et al. | 125/21 |
| 4,986,252 | * | 1/1991 | Holmes et al. | 125/21 |
| 4,998,775 | | 3/1991 | Hollifield . | |
| 5,173,250 | | 12/1992 | Ichikawa . | |
| 5,176,426 | | 1/1993 | Adamson . | |
| 5,223,200 | | 6/1993 | Schulz . | |
| 5,297,182 | | 3/1994 | Cepkauskas . | |
| 5,305,729 | | 4/1994 | Chiuminatta . | |
| 5,329,562 | | 7/1994 | Kubo . | |
| 5,363,603 | | 11/1994 | Miller . | |
| 5,429,109 | | 7/1995 | Chiuminatta . | |
| 5,452,943 | | 9/1995 | Campbell . | |
| 5,477,845 | | 12/1995 | Zuzelo . | |
| 5,568,758 | * | 10/1996 | Moore | 83/745 |
| 5,570,677 | | 11/1996 | Chiuminatta . | |
| 5,575,271 | | 11/1996 | Chiuminatta . | |
| 5,579,753 | | 12/1996 | Chiuminatta . | |
| 5,588,418 | | 12/1996 | Holmes . | |
| 5,605,381 | | 2/1997 | Schmoock . | |
| 5,664,553 | | 9/1997 | Chiuminatta . | |
| 5,713,134 | * | 2/1998 | Stevens | 30/381 X |
| 5,878,800 | * | 3/1999 | Young | 30/372 X |

* cited by examiner

*Primary Examiner*—Boyer Ashley

(57) ABSTRACT

A guide for a concrete cutting chain saw. The guide has multiple paired slots which receive a post of a bracket mounted to the chain saw. The slots provide multiple pivotal mounts for the chain saw. The chain saw is mounted on the guide with the post being received in a pair of slots. The multiple slots provide sequential pivotal mounts for moving the saw to complete the cut. The post is mountable on either end of the bracket so the guide may be mounted on either side of the cut line.

7 Claims, 6 Drawing Sheets

20
22
18
60
16
10
66
18
24
26
50
52
28
22
54
12
32
42
36
30
24
26
28
60
16

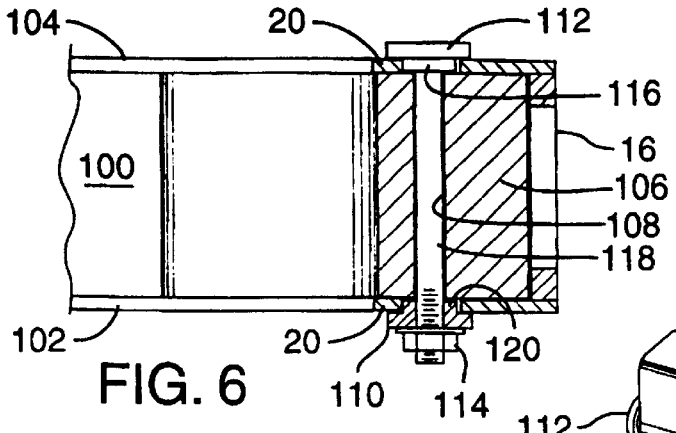
FIG. 6
FIG. 7
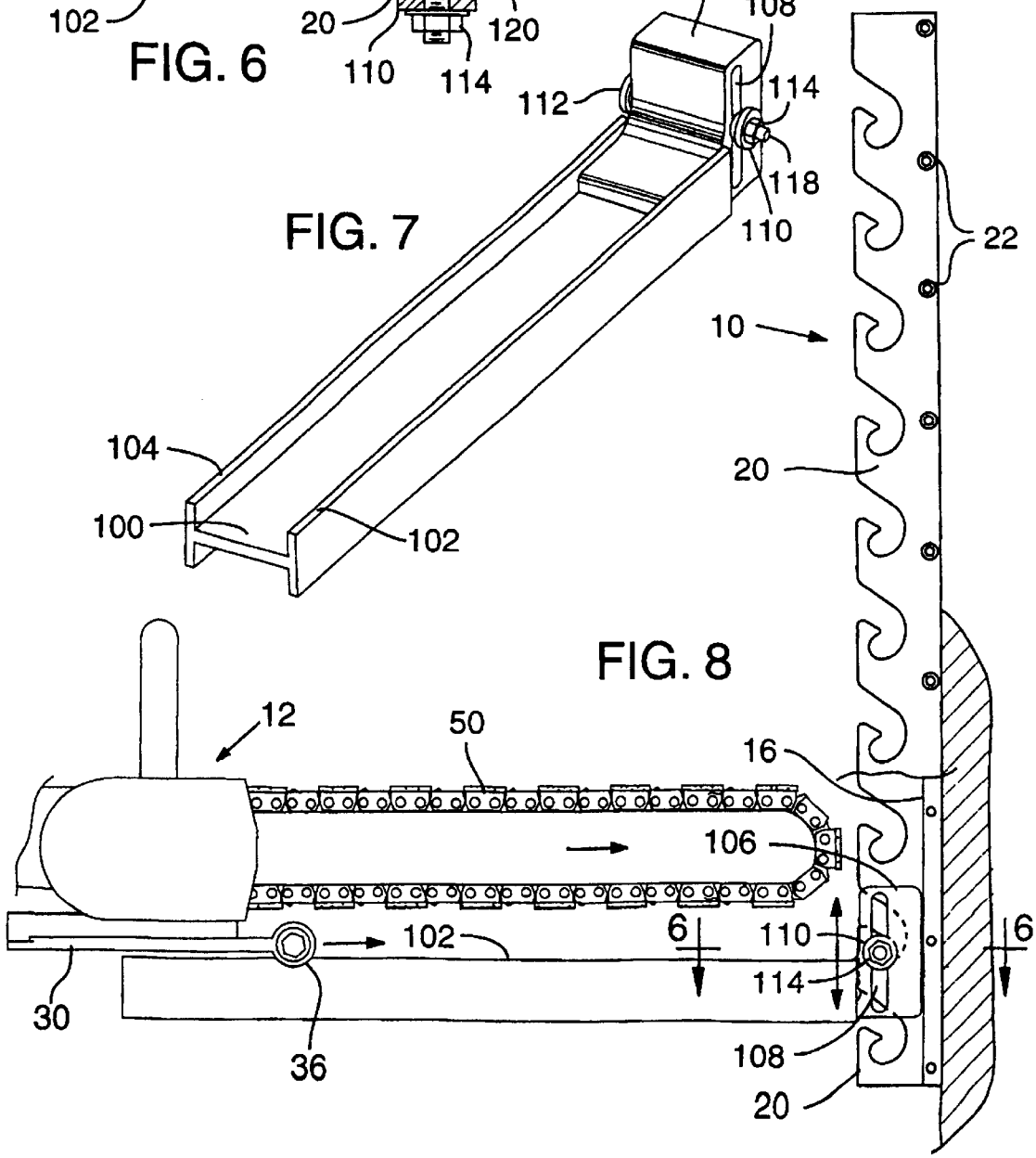
FIG. 8

GUIDE FOR CONCRETE CUTTING CHAIN SAW

FIELD OF THE INVENTION

This invention relates to a guide that can be secured to a wall for guiding a concrete cutting saw in cutting a desired straight cut in the wall.

BACKGROUND OF THE INVENTION

A concrete cutting chain saw is heavy and unwieldy and making straight cuts, e.g., to create a window or door opening in a concrete wall, is a difficult task. Such a task often requires a guide system that supports and guides the saw as the cut is being made. Heretofore such guide systems have been complex in both structure and mounting and it is desirable to find a more simple apparatus that can be easily mounted, e.g., to a wall, and still function as a guide that assists an operator in making a straight wall cut.

BRIEF DESCRIPTION OF THE INVENTION

The present invention in a preferred embodiment includes an elongated track member that is secured to a wall to be cut. It is laid alongside the desired cut line. The track member includes protruding hinge cradles spaced sequentially along the track. The saw is provided with a hinge post that is mated to the hinge cradles. With the track member secured to the wall and starting, e.g., at a point just below the top of the cut line, the hinge post of the saw is nested in a cradle of the track member and the saw blade is pivoted inwardly and downwardly along the cut line. When the cutting procedure at that cradle position is completed, the saw is lifted off the cradle and dropped into a lower subsequent cradle and the procedure repeated. The track member and hinge post are cooperatively designed so that the cut can be made at either side of the track.

The invention will be more fully appreciated upon reference to the following detailed description having reference to the accompanying drawings.

BRIEF DESCRIPTION OF THE DRAWINGS

FIG. 6 is a view as viewed on view lines 6—6 of FIG. 8;

FIG. 7 is a perspective view of the accessory bracket; and,

FIG. 8 is a view showing the accessory bracket mounted to the saw guide of FIG. 1.

DESCRIPTION OF THE PREFERRED EMBODIMENT

Figure 1:
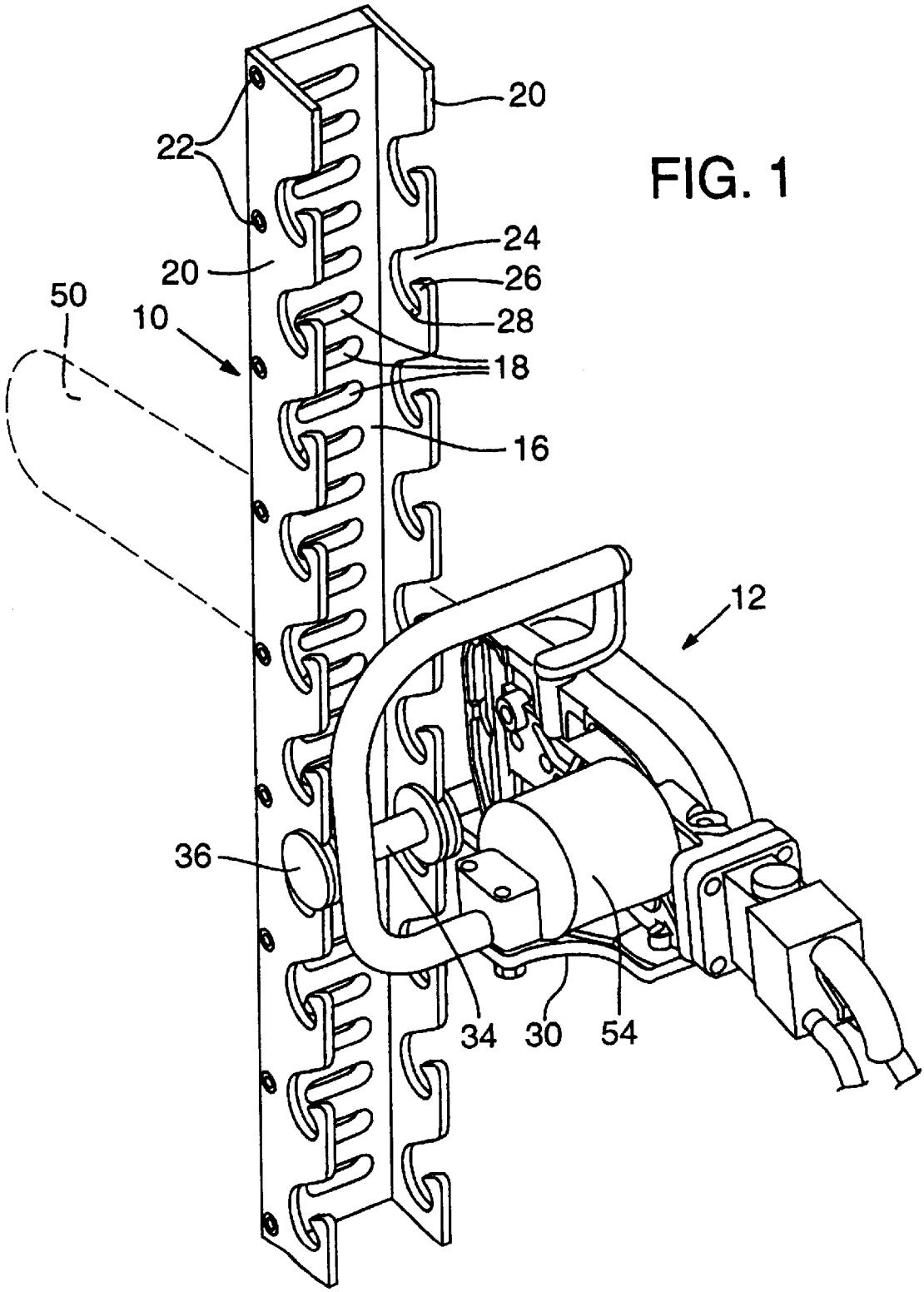
FIG. 1 is a view of a chain saw guide.

FIG. 1 illustrates a track member or guide 10 for accurately guiding and maintaining a chain saw 12 in position during a sawing operation. The guide 10 is particularly suited for sawing aggregate material. The guide 10 has a base 16 that is an elongate member having slots 18. Side members 20 are fixedly attached to the base 16 by fasteners 22. Each side 20 has formed slots (hinge cradles) 24 that serve as pivotal mounts as will later be explained. As shown, the slots 24 are spaced at intervals along each of the sides 20.

The guides 10 are provided in varying lengths to suit and may be abutted in an end to end relation for longer lengths as required. While the illustrations show the guide 10 in a vertical position, they are equally suited for horizontal or angular placement.

Figure 2:
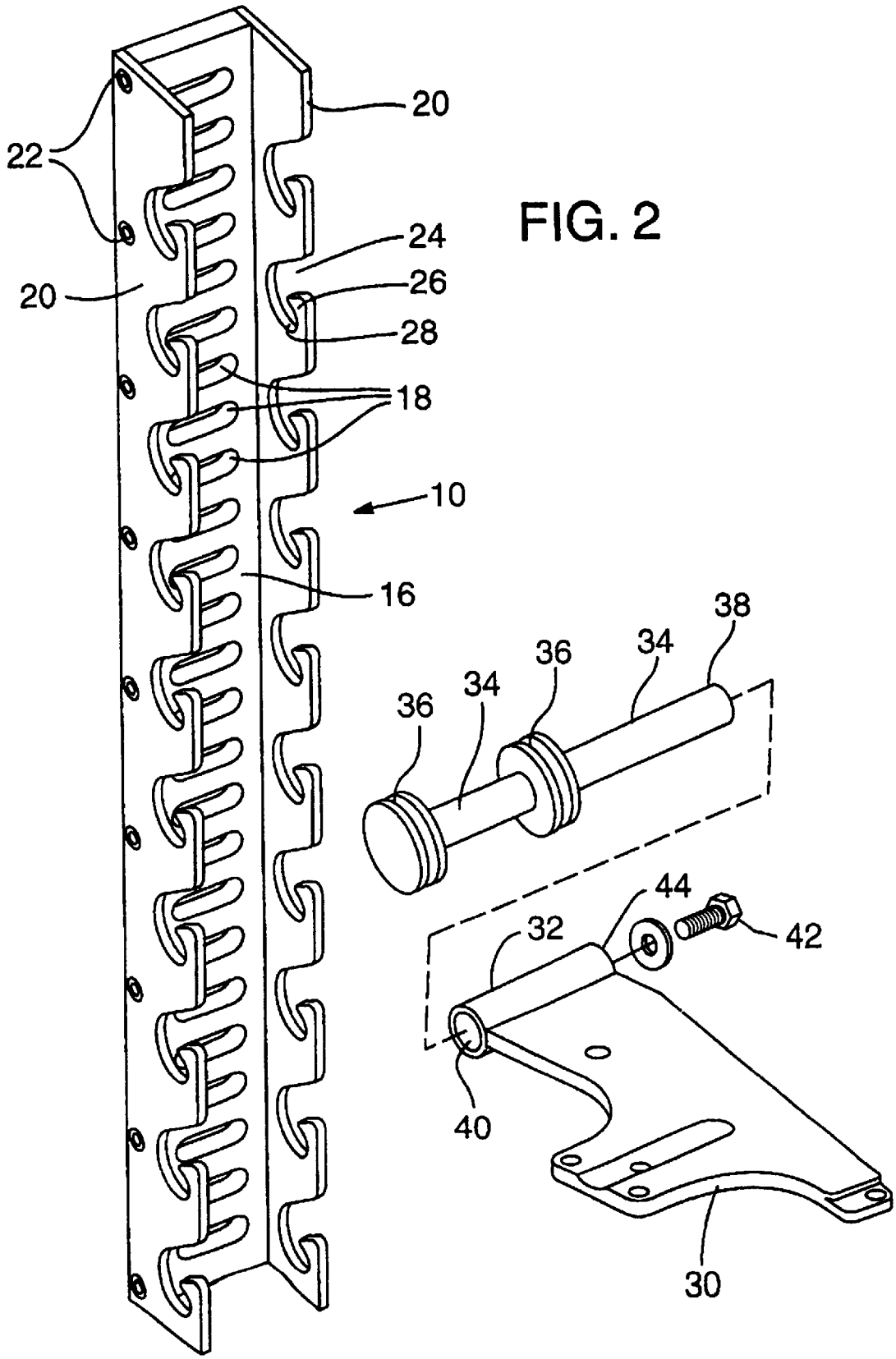
FIG. 2 is a view of the chain saw guide of FIG. 1 showing a mounting bracket for the chain saw and a mounting tube.

A bracket 30 as seen in FIG. 2 is mounted to the chain saw 12 by conventional fasteners. (However, it will be appreciated that it could be integrated into the design of the saw.) A mounting tube 32 is provided on one end of the bracket 30 and is arranged to receive a post 34. The post 34 has spools 36 mounted in a spaced arrangement.

The post 34 is arranged to be inserted or mounted in the tube 32 in two different arrangements. As shown in FIG. 2, the end 38 of the post 34 is inserted into the end 40 of the tube 32 and is retained in position by a fastener 42. Conversely the post 38 may be inserted into the end 44 of the tube 32 to position the spools 36 on the opposite side of the bracket 30. This provides the ability of providing a saw cut on either side of the guide 10. When the post is inserted into end 40, the guide bar 50 when the chain saw 12 is installed on the guide 10 will be positioned on one side of the guide 10 and when the post 34 is inserted into end 44, the guide bar 50 will be positioned on the opposite side of the guide 10. The post 34 serves as a complimentary pivotal mount that is matable with the slots 24 of the guide 10.

Figure 3:
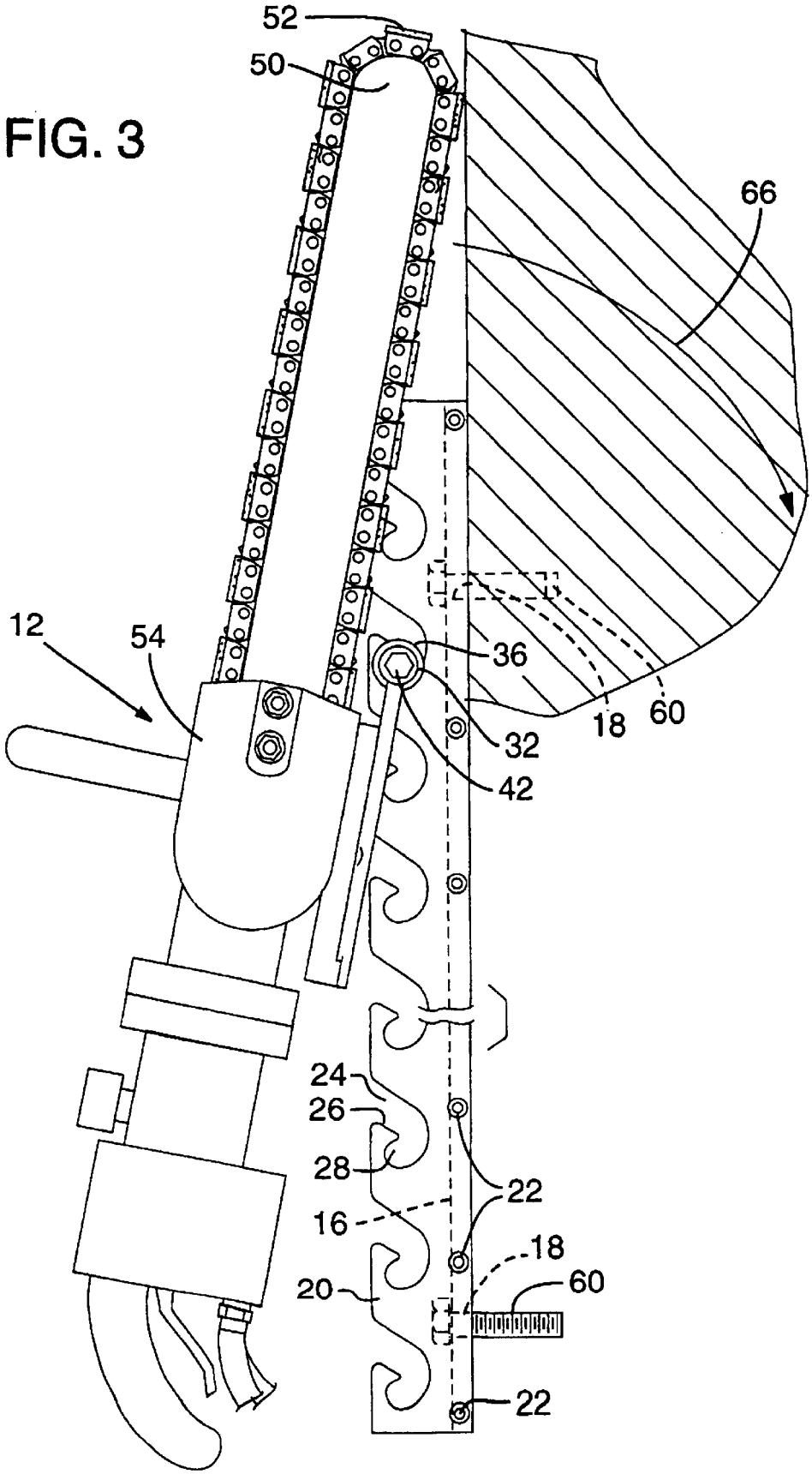
FIG. 3 is a view illustrating a chain saw mounted to the guide and in the process of making a cut.

Refer now to FIG. 3 of the drawings. FIG. 3 illustrates a typical operation for making a saw cut in aggregate material by the chain saw 12. The chain saw 12 is of a type that has a guide bar 50 on which a saw chain 52 is mounted and is driven by a power head 54 of the chain saw 12. In this embodiment, the bracket 30 and the post 34 are mounted to the chain saw 12 in the manner illustrated in FIG. 1. This positions the guide bar 50 and the saw chain 52 to right of the bracket as shown in the figures. The guide 10 is secured in a desired position on the material to be cut by fasteners 60. The fasteners 60 are inserted through the slot 18 of the guide 10 and are secured to the material in a conventional manner. The slots 18, which are elongated permit adjusting the guide 10 to accurately position the guide 10 relative to the desired cut line.

Figure 4:
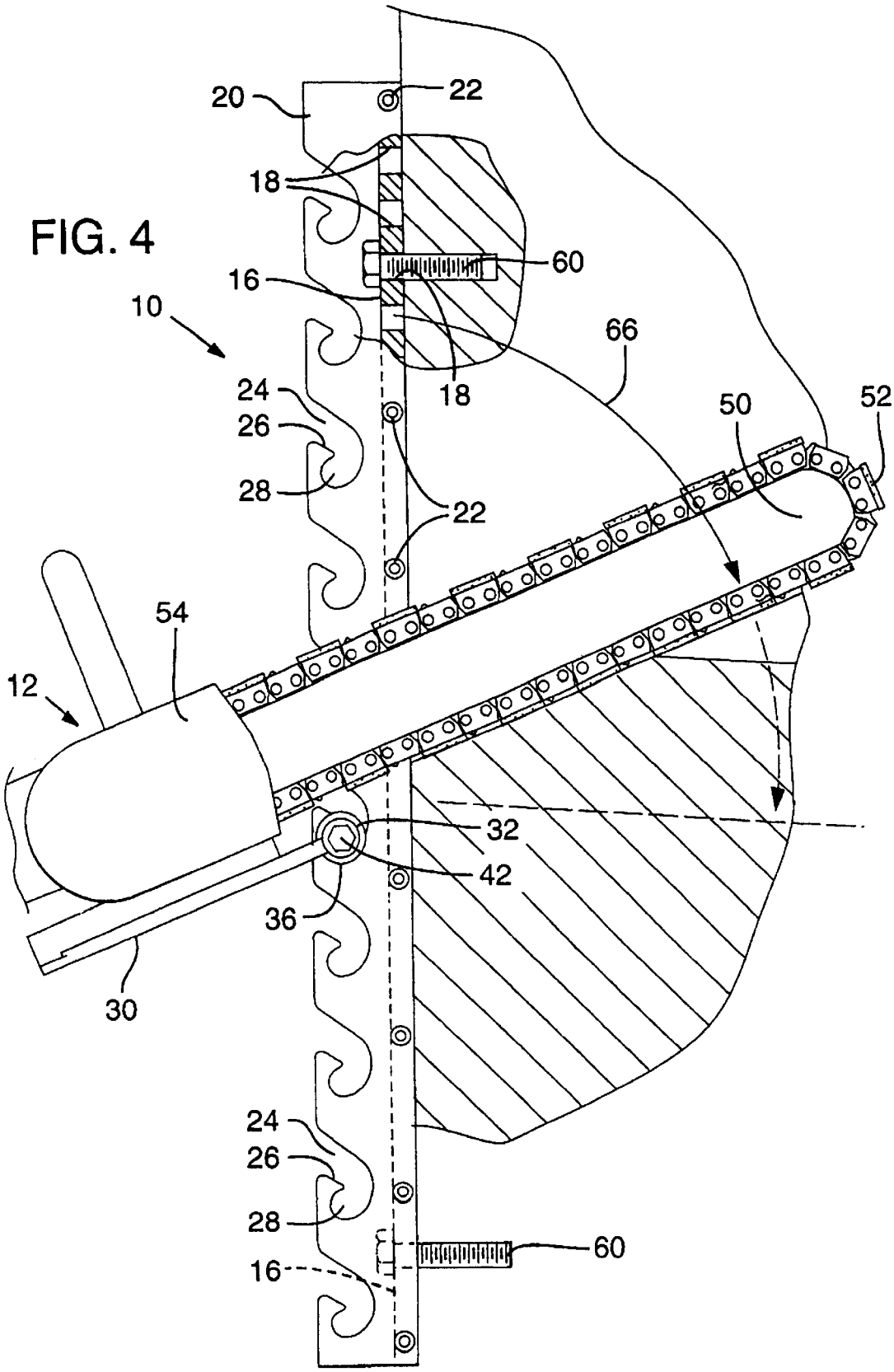
FIG. 4 is another view of the chain saw mounted to the guide and in the process of making a cut.

FIG. 1 illustrates the chain saw 12 being inserted into one pair of slots 24. The slots 24 are configured to receive the posts 34 and are sized to accommodate the diameter of the post 34. The slots 24 have a formed hook 26 that defines a recess 28. FIG. 1 illustrates the post 34 in the process of being inserted into the slots 24 and FIGS. 3 and 4 show the post 34 being fully seated in the recess 28. The sides 20 of the guide 10 are received in the spools 36. The spools 36 prevent lateral movement of the post 34 mounted to the chain saw 12. The hook portion 26 of the slot 24 will retain the post 34 and thus the chain saw 12 in position on the guide 10. As seen in FIGS. 3 and 4, the post 34 provides an axis of pivot for the guide bar 50 and the guide bar 50 may be pivoted about the post 34 in the direction indicated by arrow 66.

Refer now to FIG. 3 of the drawings. The chain saw 12 is initially pivoted upward to facilitate making the initial cut in the aggregate material. The chain saw 12 is positioned on the guide 10 with the sides 20 being received in the center of the spools 36 and the post 34 fully seated in the recess 28. The chain saw 12 is pivoted on the post 34 which moves the guide bar 50 in the direction indicated by arrow 66. The post 34 being fully seated in the recess 28 maintains the position of the chain saw 12 relative to the bracket 10 and thus to the desired path of cut in the material. The chain saw 12 is continued to be pivoted on the post 34 and the cut will progress such as shown in FIG. 4. When the guide bar 50 has been pivoted downward (in the direction indicated by arrow 66) a desired degree, the saw 12 is removed from the pair of slots 24 in which it was mounted and is moved to a next pair of slots 24. The sawing operation continues until the full length of cut has been completed.

Figure 5:
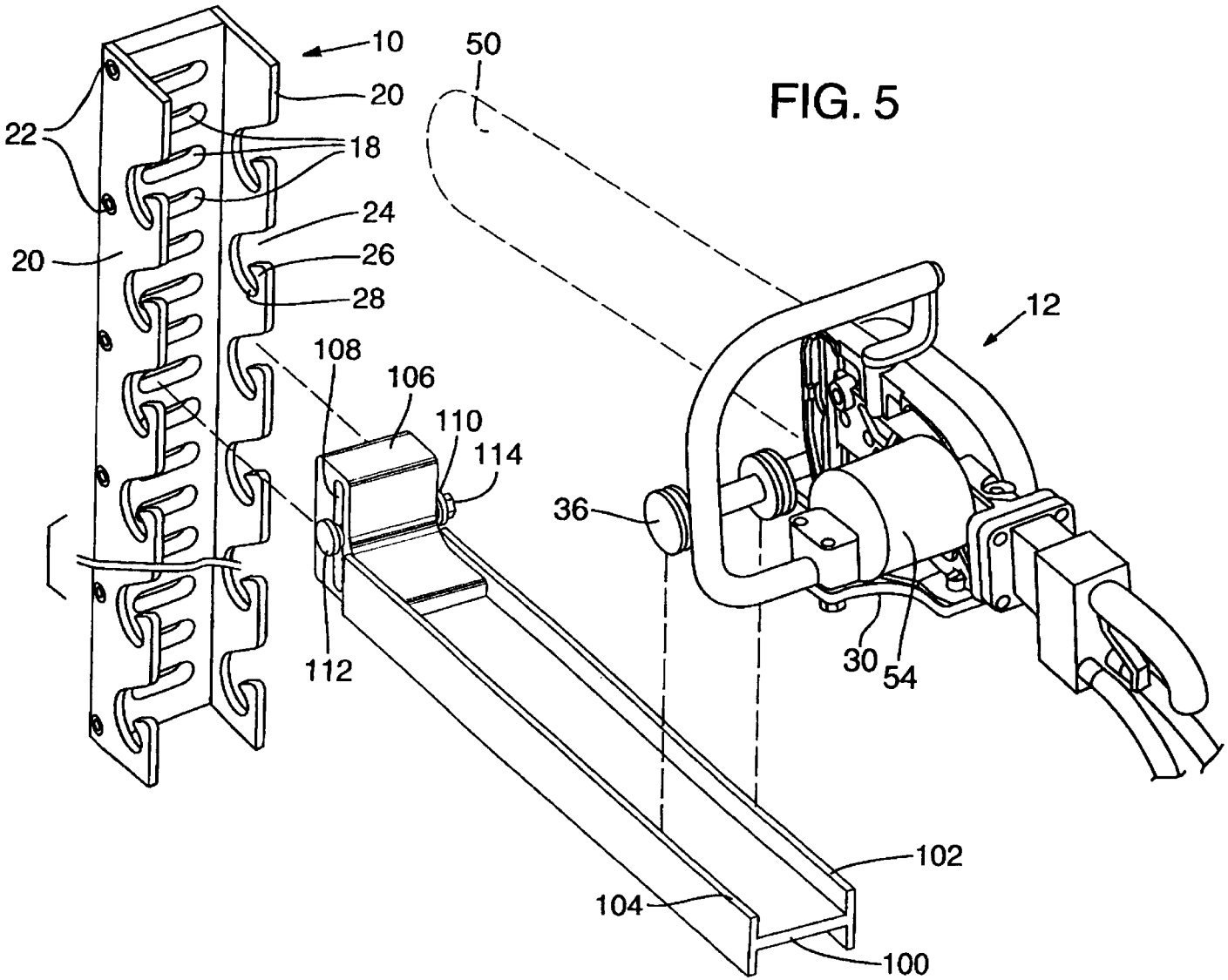
FIG. 5 illustrates an accessory bracket for the chain saw guide of FIG. 1.

FIG. 5 illustrates an accessory bracket 100 that is mountable to the saw guide 10. The bracket 100 is mountable to the guide 10 and provides a support for the chain saw 12. The bracket 100 is of the I-beam type having upstanding legs 102, 104. The legs 102, 104 are in the same spacial distance as the sides 20 of the guide 10. An L-shaped bracket 106 is fixedly mounted to the bracket 100. The bracket 106 has a slot 108 which is provided to facilitate mounting the bracket 100 to the guide 10. A mounting pin 112 has a shoulder 116 sized to fit in the recess 28 of the guide 10. The shank 118 of the pin 112 is sized to fit in the slot 108 of the bracket 106.

The pin 112 sized to fit in the recess 28 of the sides 20 of the guide 10 and the slot 108 secures the bracket 100 to the guide 10. The bracket 100 is mounted between the sides 20 of the guide 10 with the L-shaped bracket 106 fitting against the base 16 of the guide 10. The bracket 100 is adjusted upwardly or downwardly as required to a desired position and the pin 112 is inserted into a recess 28 and through the slot 108 and into the opposite recess 28 of the opposite side 20. A washer 110 having a shoulder portion 120 sized to fit the recess 28 (FIG. 6) is fitted on the end of the pin 110 and is secured by a nut 114. The pin 110 fitting in the slot 108 of the bracket 100 permits the bracket 100 to be adjusted upwardly and downwardly to a final adjustment. When the bracket 100 is in its final adjusted position, the nut 114 is tightened which forces the shoulder 116 of the pin 112 and the shoulder 120 of the washer 110 against the L-shaped bracket 106 to fixedly secure the bracket 100 to the guide 10.

The bracket 100 is particularly suited for making a plunge cut into the material to be sawn and is most often used to make a square cut or a straight cut into the material. Referring to FIG. 8, the chain saw 12 is fitted to the bracket 100 with the spools 36 riding on the legs 102, 104 of the I-beam bracket 100. The chain saw 12 thus may be moved toward and away from the guide 10 on the bracket 100.

Those skilled in the art will recognize that modifications and variations may be made without departing from the true spirit and scope of the invention. The invention is therefore not to be limited to the embodiments described and illustrated but is to be determined from the appended claims.

The invention claimed is:

1. A concrete cutting chain saw and guide therefor comprising:

a chain saw including a power head, a guide bar mounted to the power head and a concrete cutting saw chain mounted on the power head and guide bar to be driven around the guide bar for cutting a concrete work piece having a planar surface;

a chain saw guide including an elongate straight track member mountable to the planar surface, a sequence of pivotal mounts provided on the elongate straight track member; and a complimentary pivotal mount provided on the chain saw releasably matable individually and sequentially to the pivotal mounts on the track member enabling the chain saw to be sequentially mounted on the pivotal mounts of the elongate straight track member, said pivotal mounts configured to cooperatively provide precise orientation of the chain saw for stepped pivotal cutting of the chain saw along a desired cutting line.

2. A concrete cutting chain saw and guide as defined by claim 1 wherein a bracket is mounted to the chain saw and the complimentary pivotal mount is provided on the bracket.

3. A concrete cutting chain saw and guide as defined in claim 2 wherein a mounting tube is fixedly provided on the bracket of the power head and a post is removably inserted in the mounting tube and laterally projected from the power head, said pivotal mounts on the elongate straight track member provided as hook-shaped projections that secures mating of the pivotal mounts during pivotal cutting.

4. A concrete cutting chain saw and guide as defined in claim 3 wherein a pair of spaced apart spools are provided on the post and each pivotal mount includes a pair of hook shaped projections spaced apart to receive the pair of spaced apart spools, said spools, hook shaped projections and mounting brackets as mounted to the chain saw cooperatively positioned to position the cutting chain as mounted on the guide bar in alignment with the cutting line.

5. A concrete cutting chain saw as defined in claim 4 wherein the post is mountable in either of opposed ends of the mounting tube to accommodate mounting of the guide member at either side of the cutting line.

6. A concrete cutting chain saw and guide therefor comprising:

a chain saw including a power head, a guide bar mounted to the power head and a concrete cutting saw chain mounted on the power head and guide bar to be driven around the guide bar for cutting a concrete work piece having a planar surface;

a chain saw guide including an elongate straight track member mountable to the planar surface, a sequence of mounts provided along the elongate straight track member, said mounts cooperatively arranged to define a cutting line; and a guide bracket having opposed ends and a length between said ends, an attachment head provided at one end, a complimentary mount secured to said head and mated to the mounts of said chain saw guide, said guide bracket having an upper elongate guide section along said length and extended perpendicular to the elongate straight track member, said chain saw including a guide portion mated to the guide section whereby the chain saw is movable along said guide section with the cutting chain and bar directed into the work piece.

7. A concrete cutting chain saw as defined in claim 6 wherein said complimentary mount is adjustably secured to said head end for limited adjustment of the head end relative to said complimentary mount.

* * * * *